US007780037B2

(12) United States Patent
Corbellini et al.

(10) Patent No.: US 7,780,037 B2
(45) Date of Patent: Aug. 24, 2010

(54) UNITARY COSMETIC COMPACT WITH DECOUPLED MOTION

(75) Inventors: Francis Corbellini, Thiais (FR); Herve Bouix, New York, NY (US)

(73) Assignee: ELC Management LLC, New York, NY (US)

( * ) Notice: Subject to any disclaimer, the term of this patent is extended or adjusted under 35 U.S.C. 154(b) by 995 days.

(21) Appl. No.: 11/537,210

(22) Filed: Sep. 29, 2006

(65) Prior Publication Data

US 2008/0142532 A1 Jun. 19, 2008

(51) Int. Cl.
*B65D 43/20* (2006.01)

(52) U.S. Cl. ..... 220/813; 220/811; 220/812

(58) Field of Classification Search ..... 220/813, 220/811, 812; 401/60
See application file for complete search history.

(56) References Cited

U.S. PATENT DOCUMENTS

| | | | | | |
|---|---|---|---|---|---|
| 234,280 | A | | 11/1880 | Hopfen | |
| 238,959 | A | | 3/1881 | Parker | |
| 343,678 | A | * | 6/1886 | Tatum | 220/813 |
| 947,198 | A | * | 1/1910 | Herzstam | 401/60 |
| 1,247,848 | A | * | 11/1917 | List | 206/45.23 |
| 1,675,496 | A | * | 7/1928 | Kasdan et al. | 401/60 |

(Continued)

FOREIGN PATENT DOCUMENTS

JP 61-118508 7/1986

(Continued)

OTHER PUBLICATIONS

PCT International Search Report; International Application No. PCT/US07/078981; Completion Date: Feb. 13, 2008; Date of Mailing: Feb. 13, 2008.

(Continued)

*Primary Examiner*—Anthony Stashick
*Assistant Examiner*—Christopher B McKinley
(74) *Attorney, Agent, or Firm*—Peter Giancana

(57) ABSTRACT

The present invention is a convenient-to-use cosmetic compact of increased stability, comprising a base, a cosmetic article carrier disposed within the base and a cap. With respect to the base, the cap is sometimes capable of translational movement and sometimes capable of rotational movement, but the cap can only perform one type of motion at a time. The type of movement that the cap may execute, depends on the relative orientation of the cap and base. There is one exception to this rule. There is exactly one orientation of the cap with respect to the base from which the user may execute either translation or rotation, but not both simultaneously.

Translation of the cap with respect to the base causes translation of the cosmetic article carrier, either toward the bottom or toward the top of the base. In contrast, rotation of the cap with respect to the base does not affect the position of the cosmetic article carrier. Preferably, the cap is capable of rotating at least 180°.

A selective rotation mechanism decouples translational motion of the cap from rotational motion of the cap. Thus, compound movement of the cap, with respect to the base, is not possible. Inadvertent movement of the carrier is eliminated, because when the device is in an orientation for use, translational movement of the carrier is prohibited. This feature creates greater stability during use. The device may be operated with one fluid motion by the user.

24 Claims, 6 Drawing Sheets

U.S. PATENT DOCUMENTS

| | | | | | |
|---|---|---|---|---|---|
| 1,678,282 | A | * | 7/1928 | Coryell | 401/60 |
| 1,693,151 | A | * | 11/1928 | Mayer | 401/60 |
| 1,698,750 | A | * | 1/1929 | Coryell | 401/60 |
| 1,720,274 | A | * | 7/1929 | Holden | 206/755 |
| 1,734,116 | A | * | 11/1929 | Coryell | 401/60 |
| 1,734,117 | A | * | 11/1929 | Coryell | 401/60 |
| 1,793,192 | A | * | 2/1931 | Poranski | 401/60 |
| 1,904,364 | A | | 4/1933 | Fulmer | |
| 1,925,316 | A | | 9/1933 | Fullmer | |
| 1,997,043 | A | * | 4/1935 | Clark | 206/246 |
| 2,031,933 | A | | 2/1936 | Clegg | |
| D145,286 | S | | 7/1946 | Crane | |
| D148,294 | S | | 1/1948 | Gold | |
| 2,441,303 | A | | 5/1948 | Wesson et al. | |
| 2,485,837 | A | | 10/1949 | Nadelson | |
| 2,512,476 | A | * | 6/1950 | Birnkrant et al. | 132/316 |
| 2,540,304 | A | * | 2/1951 | Thomsen | 401/60 |
| 2,547,971 | A | * | 4/1951 | Polin et al. | 132/297 |
| 2,556,500 | A | | 6/1951 | Levine | |
| 2,678,459 | A | | 5/1954 | Stuckey | |
| 2,983,276 | A | * | 5/1961 | Brown | 401/7 |
| 3,033,258 | A | * | 5/1962 | Pollard et al. | 206/316.2 |
| D197,368 | S | | 1/1964 | Sydlowski | |
| 3,333,726 | A | | 8/1967 | Belanger | |
| 3,783,999 | A | * | 1/1974 | Smith | 206/45.23 |
| 4,126,145 | A | | 11/1978 | Boyd | |
| 4,388,935 | A | | 6/1983 | Napolitane | |
| 4,615,461 | A | | 10/1986 | Liu | |
| 4,666,036 | A | * | 5/1987 | Bourbon | 206/45.23 |
| 4,915,527 | A | * | 4/1990 | Asano et al. | 401/60 |
| 5,054,505 | A | | 10/1991 | Yuhara | |
| 5,107,871 | A | | 4/1992 | Butcher et al. | |
| 5,353,947 | A | * | 10/1994 | Zinnbauer et al. | 220/812 |
| 5,372,249 | A | * | 12/1994 | Grange | 206/45.23 |
| 5,391,011 | A | | 2/1995 | Gueret | |
| 5,411,134 | A | * | 5/1995 | Temple et al. | 206/753 |
| D360,057 | S | * | 7/1995 | Bow | D28/85 |
| 5,437,294 | A | | 8/1995 | Ebbets, III et al. | |
| 5,568,820 | A | | 10/1996 | Dirksing | |
| 5,605,167 | A | | 2/1997 | Montoli | |
| 5,638,838 | A | | 6/1997 | Lombardi | |
| 5,732,820 | A | * | 3/1998 | Tsai | 206/369 |
| 5,842,486 | A | | 12/1998 | Davis et al. | |
| 5,845,658 | A | | 12/1998 | Sussman | |
| 6,002,651 | A | | 12/1999 | Baccaray | |
| 6,029,848 | A | | 2/2000 | Cha et al. | |
| 6,056,465 | A | | 5/2000 | Kuo | |
| 6,173,838 | B1 | | 1/2001 | Brozell | |
| 6,196,405 | B1 | * | 3/2001 | Kambouris | 220/4.22 |
| 6,199,559 | B1 | | 3/2001 | Nikolaus et al. | |
| 6,200,051 | B1 | | 3/2001 | Gueret | |
| 6,227,208 | B1 | | 5/2001 | Imbert | |
| 6,283,291 | B1 | * | 9/2001 | Vasudeva et al. | 206/373 |
| 6,286,521 | B1 | * | 9/2001 | Joulia | 132/295 |
| 6,412,640 | B1 | | 7/2002 | Destanque et al. | |
| 6,581,774 | B1 | * | 6/2003 | Galafassi et al. | 206/553 |
| 6,769,438 | B2 | | 8/2004 | Fraillon | |
| 7,014,045 | B2 | | 3/2006 | Lin | |
| 7,140,511 | B2 | * | 11/2006 | Baker et al. | 220/813 |
| 2004/0056035 | A1 | * | 3/2004 | Baker et al. | 220/345.1 |
| 2004/0187885 | A1 | | 9/2004 | Strong et al. | |
| 2004/0221866 | A1 | | 11/2004 | Greenfield | |
| 2005/0199259 | A1 | | 9/2005 | Dumler et al. | |
| 2006/0005853 | A1 | | 1/2006 | Shen | |
| 2006/0022164 | A1 | | 2/2006 | Su | |

FOREIGN PATENT DOCUMENTS

| | | |
|---|---|---|
| JP | 03047078 | 3/1998 |
| JP | 2005304914 | 11/2005 |
| JP | 2006325923 | 12/2006 |
| KR | 20-0369800 | 12/2004 |
| KR | 20050013279 | 2/2005 |

OTHER PUBLICATIONS

PCT Written Opinion Of the International Searching Authority, Or The Declaration; International Application No. PCT/US07/078981; Completion Date: Feb. 13, 2008; Mailing Date: Feb. 13, 2008.

PCT International Search Report; International Application No. PCT/US2007/086799; Completion Date: May 7, 2008; Date of Mailing: May 7, 2008.

PCT Written Opinion Of the International Searching Authority, Or The Declaration; International Application No. PCT/US2007/086799; Completion Date: May 7, 2008; Mailing Date: May 7, 2008.

* cited by examiner

UNITARY COSMETIC COMPACT WITH DECOUPLED MOTION

FIELD OF THE INVENTION

The present invention relates to the packaging of various personal care articles, such as cosmetic or dermatologic products and ancillary items, such as brushes or other applicators. Specifically, the present invention concerns improved compact devices of unitary construction whose components can be oriented by a user to expose the cosmetic article for use.

BACKGROUND

There are many containers whose cap and base can be reoriented by a user to expose an enclosed article for use. Of concern here, is a type of container having a cap that is capable of translation and rotation with respect to a base and wherein an article carrier translates within the base to expose or hide the article.

In all of the following patents (U.S. Pat. Nos. 234,280; 238,959; 947,198; 1,693,151; 1,734,117; D148,294; 2,556,500; 3,033,258; D197,368; 4,915,527; D360,057; 5,391,011; 6,200,051), the cap can rotate and translate simultaneously. This features are disadvantageous. The ability of the cap to perform compound motion (simultaneous translation and rotation) decreases the stability of the compact in the users hands, not only when the compact is being opened and closed, but also when the user is manipulating the compact during use. This may be especially true for relatively small cosmetic compacts which tend to have a small gripping area. For cosmetic and other compacts, it would be better if the cap was unable to perform compound motion, that is, if the translational (vertical) and rotational motion were decoupled and performed in succession, rather than simultaneously. Such is the case in the present invention, wherein it is not possible to translate and rotate the cap simultaneously.

Regarding U.S. Pat. No. 1,693,151 it is possible to translate and rotate the cap simultaneously, however, it is disclosed that means may be provided to discourage this compound motion of the cap. Even when such means are provided, compound motion is only discouraged, not prevented and it is only discouraged some of the time, not all of the time. This is unlike the present invention, wherein not compound motion of the cap is possible. One disadvantage of the device in this reference is that, when the cap is rotated 180° so that the cap is sitting under the base, translational movement of the can is still possible. Another disadvantage is that when the cap is rotated 180° so that the cap is sitting under the base, additional force on the part of the user is required to overcome the snap engagement of the cap to the base, before the cap can be rotated toward the top of the compact. The present invention does not have these disadvantages.

Furthermore, in all of the following references (U.S. Pat. Nos. 234,280; 238,959; 947,198; 1,693,151; 1,734,117; 1,793,192; 1,904,364; D145,286; D148,294; 2,556,500; D197,368; 4,915,527; D360,057) it is possible, in some case likely, that pressure directly applied to the exposed article (i.e. during use) will cause the article to shift, thereby creating an unstable situation. In some cases, this depends on how the user grips the compact. It would be better if the article carrier was prevented from moving as a result of axial pressure being applied to the article, regardless of how the user grips the compact. Such is the case in the present invention, wherein it is not possible, in any reasonable use, to move the cosmetic article carrier as a result of pressure applied directly to the cosmetic article.

Furthermore, in the following references (U.S. Pat. Nos. 947,198; 1,693,151; 1,734,117; D148,294; 2,556,500; D197,368; 4,915,527; D360,057) it is possible to fully expose the cosmetic article before the article has reached its final vertical position. Generally, this happens because the cap has been rotated away from the cosmetic article, thus exposing the article, even while the article is still being maneuvered into position for use. This is a disadvantage if the article should not have inadvertent contact with another surface. For example, if the article is a cosmetic stick product, chances are increased that the stick will inadvertently contact some portion of the user or user's clothing or other surface, if the stick is exposed while the compact is being manipulated into a ready-for-use orientation. It would be better if the cosmetic article was not fully exposed until the article carrier was in its ready-to-use position. Such is the case is the present invention, wherein the cosmetic article translates to a final position and, only then, does the cap pivot away from the article.

Some pivoting-cap compacts (U.S. Pat. Nos. 234,280; 2,540,304; 2,678,459; 5,391,011; 6,200,051; US2004/0187885) require more than one effort on the part of the user. By "more than one effort" we mean that the user must grasp and re-grasp portions of the compact in order to complete the opening and closing operation. Sometimes this is a result of the compact not being a unitary device and sometimes it is a result of the complexity of the device. When the compact is not a unitary device a further disadvantage is that components of the compact may become lost. Better would be a unitary compact that that requires only one fluid motion by the user, in order to open and close the compact.

In some of the referenced designs (i.e. U.S. Pat. Nos. 947,198 and 1,904,364), the cap cannot rotate 180°, all the way around to the bottom of the base. This is undesirable, because the cap hangs out in space, getting in the way of the user.

Some devices are quite a bit more complex that the present invention, for example, those disclosed in U.S. Pat. Nos. 1,904,364 and 2,540,304.

Of the references cited above, none discloses a unitary cosmetic compact comprising a base, a cap and an article carrier, wherein the cap is capable of translation and rotation with respect to the base, such that once the cap has rotated away from a coaxial orientation with the base, the cap is no longer capable of translation; and wherein there is only one orientation of the cap with respect to the base from which both translation and rotation are possible; and wherein the cap is prevented from pivoting and translating at the same time. Furthermore, the applicant is not aware of any such compacts that incorporate a selective rotation mechanism, as disclosed herein.

SUMMARY OF THE INVENTION

The present invention is a convenient-to-use, unitary cosmetic compact of increased stability, comprising a base, a cosmetic article carrier disposed within the base and a cap. With respect to the base, the cap is sometimes capable of translational movement and sometimes capable of rotational movement, but the cap can only perform one type of motion at a time. Furthermore, the user does not have a choice, in that, the type of movement (translation or rotation) that the cap may execute is dictated by the relative orientation of the cap and base. There is one exception to this rule. There is exactly one orientation of the cap with respect to the base from which the user has a choice to execute either translation or rotation, but not both simultaneously. In any other orientation, the cap has only one type of movement available to it. At all times, translation of the cap with respect to the base causes translation of the cosmetic article carrier, either toward the bottom or toward the top of the base. Rotation of the cap with respect to the base does not affect the position of the cosmetic article carrier.

Preferably, the cap is capable of rotating at least 180°. The present invention is unique, in part, because the translational (or vertical) motion of the cap is decoupled from the rotational (or pivoting) motion of the cap. Put another way, compound movement of the cap, with respect to the base, is not possible. "Compound movement" means two or more types of motion occurring simultaneously, i.e. translation and rotation. Furthermore, when pressure is applied to the cosmetic article (during use, for example) the cosmetic article and carrier cannot move with respect to the base. Inadvertent movement of the carrier is eliminated because, when the device is in an orientation for use, translational movement of the carrier is prohibited. These features create greater stability during use. The user is less likely to fumble with the device or have the device move inadvertently during use. The device may be operated with one fluid motion by the user.

DETAILED DESCRIPTION

Throughout this specification, the terms "comprise," "comprises," "comprising" and the like shall consistently mean that a collection of objects is not limited to those objects specifically recited.

"Unitary compact" or the like, means that the components of the claimed invention are connected, at all times, during use. The connections between the components restrict the degrees of freedom of the components, with respect to one another. So, for example, a compact and applicator that are separated during use, do not form a unitary compact, even if they are sometimes connected during use.

"Translation" and related syntactic forms refer to linear motion of an element, apart from rotation of the element. "Rotation" and related syntactic forms refer to motion of an element about a physical pivot, apart from translation of the element.

The Base

Figure 1:
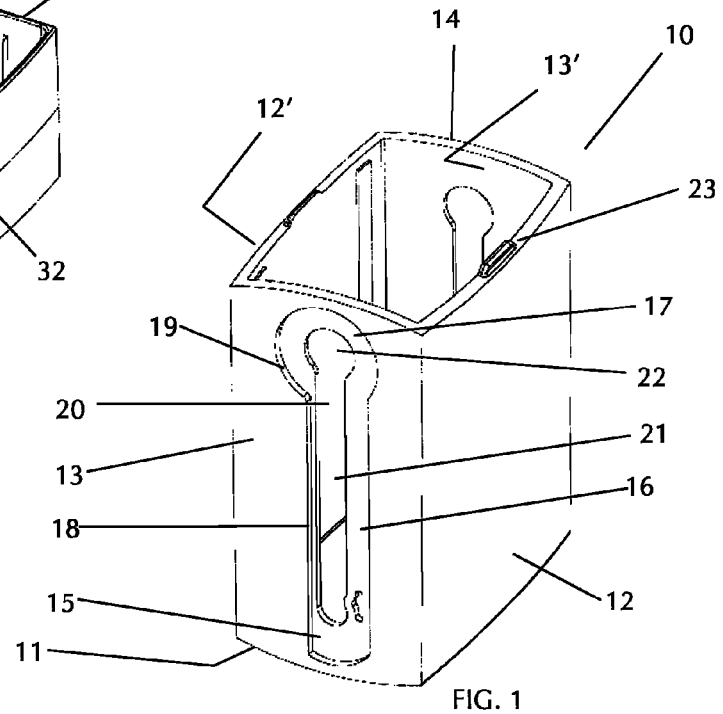
FIG. 1 is a perspective view of a base member of a unitary cosmetic compact according to the present invention.

Referring to FIG. 1, the hollow base (10) is, generally, the largest or main component of the compact. Though shown in an essentially rectangular shape, the principles of the present invention may be manifested in a base that is very different from rectangular. In the embodiment of FIG. 1, the base has a bottom wall (11), front and back walls (12, 12') and two lateral walls (13, 13'). The top (14) of the base is opened. Throughout the specification, the term "vertical" will refer to the base in the orientation shown in FIG. 1, with the bottom wall of the base closest to the earth. The designation of walls as "front", back" or "lateral" is arbitrary. The base is provided with one or more grooves (20) that run vertically, along one or more walls of the base. In the following description, the grooves are depicted as running along lateral walls of the base. The grooves pass completely through the lateral walls of the base, to create access to an article carrier inside. The base will ordinarily be fashioned from one or more plastics, by any conventional means.

By comparing FIGS. 1-5, 6 and 7, it is clear that the relative dimensions of the compact do not severely limit the implementation of the present invention. There is some practical lower limit on the width of the lateral walls (13, 13') of the base (10) because these walls must be wide enough to accommodate grooves (20) and/or recesses (explained below). In research, compacts according to the present invention, having a base width as small as three quarters of a centimeter have been constructed with no undue difficulty. It is clear that the lateral walls of the base may be narrower than three quarters of a centimeter, although at some point, the device will become too small for a user to handle, conveniently. Therefore, as a practical matter, approximately one half centimeter is a lower limit for the width of the lateral walls of the base or a lower limit for the width of that feature which encompasses the grooves. Furthermore, one quarter centimeter is an approximate lower limit of the width of the grooves.

The Article Carrier

Figure 2:
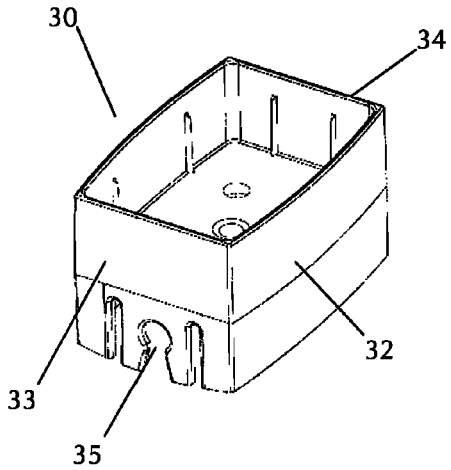
FIG. 2 is a perspective view of a cosmetic article carrier of a unitary cosmetic compact according to the present invention.
Figure 5A:
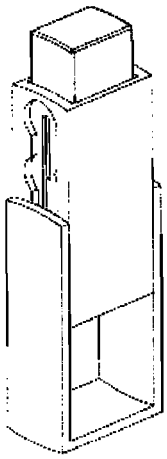
FIGS. 5*a*-5*c* show an embodiment wherein the base has three positions for rotating the cap.
Figure 5B:
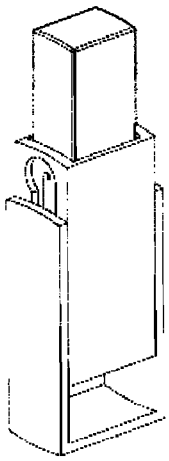
Figure 5C:
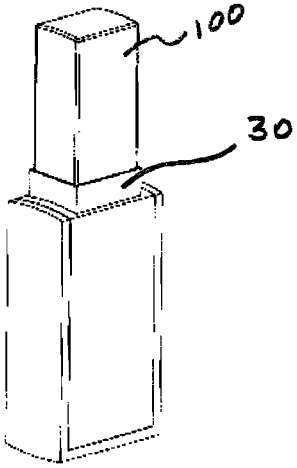

In FIG. 2, the article carrier (30) is a receptacle for an article that is being housed in the device. The carrier may be any suitable construction capable of securely holding a cosmetic article. "Securely holding" means that the article is retained in the article carrier during normal use and that the article carrier as been adapted to secure the article by employing means known to a person of skill in the art of compact devices. For example, the carrier may act like a cup with internal splines for holding a cosmetic stick. Or, the carrier may act as a crimped ferrule for securing bristle fibers, thus turning the whole device into a brush or comb. Or, the carrier may act as an outer receptacle that is capable of accepting and retaining a pre-filled cosmetic container; for example, a compact pan used for holding pressed powder is glued into the article carrier. In FIG. 5*c*, the cosmetic article (50) is fixed in the top (34) of the carrier, while in FIG. 6*b*, it is fixed in the front wall (32) of the carrier. In general, a cosmetic article may be associated with any of the top, front, back or lateral sides of the carrier. The carrier may ordinarily be fashioned from one or more plastics, by any conventional means.

The carrier (30) is located inside the base (10) and is capable of sliding (translating) vertically (up and down) within the base. Preferably, the exterior of the carrier is shaped complementary to the interior of the base in which it slides. This close fit will reduce motion that is not up or down. Thus, in the embodiments shown, the carrier has front and back walls (32, 32') and two lateral walls (33, 33'). Each lateral wall of the carrier is provided with an attachment to the cap (40). The attachment is effected through one or more slots (35) provided in a lateral wall of the carrier, and may be, for example, one or more pivot elements (45) extending through the groove, connecting the carrier and cap, in a snap-fitted engagement. The pivot elements may rise or protrude from the inner wall of the cap and extend toward the carrier. Alternately, each lateral wall of the carrier could be provided with a pivot that extends toward the cap. Many equivalent means will be apparent to a person skilled in the art. In either case, the carrier connects to the cap through the groove(s) (20) in the base. The connection is such that when the cap translates vertically, so does the carrier.

Figure 6A:
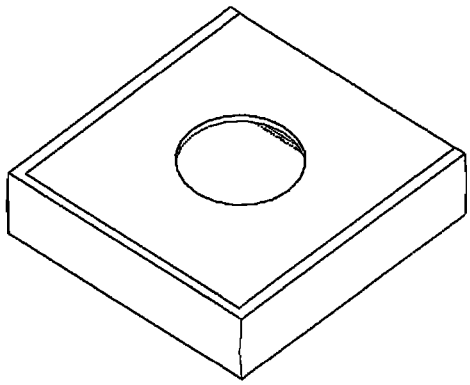
FIGS. 6*a*-6*b* are perspective views of a side-access version of a compact according to the present invention.
Figure 6B:
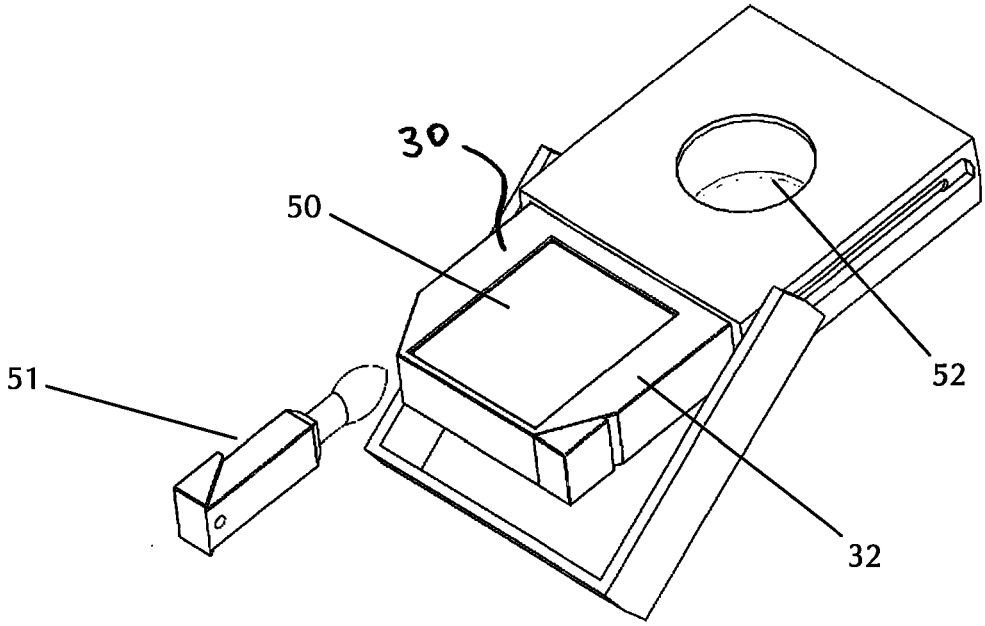
Figure 7:
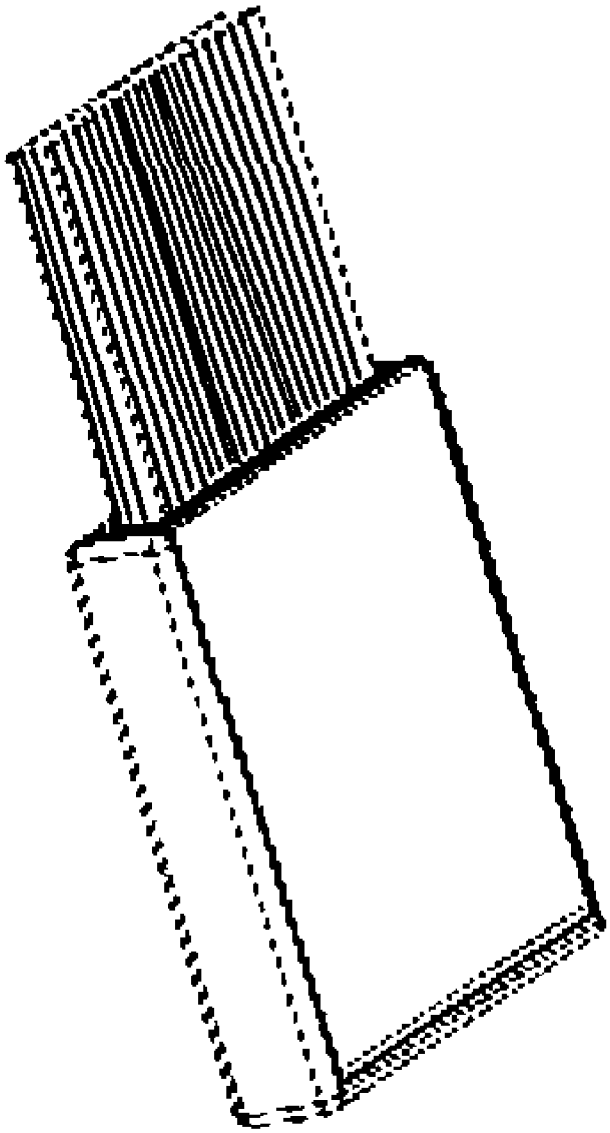
FIG. 7 is an embodiment wherein the cosmetic article is a brush.
Figures 8A, 8B, 8C, 8D, 8E:
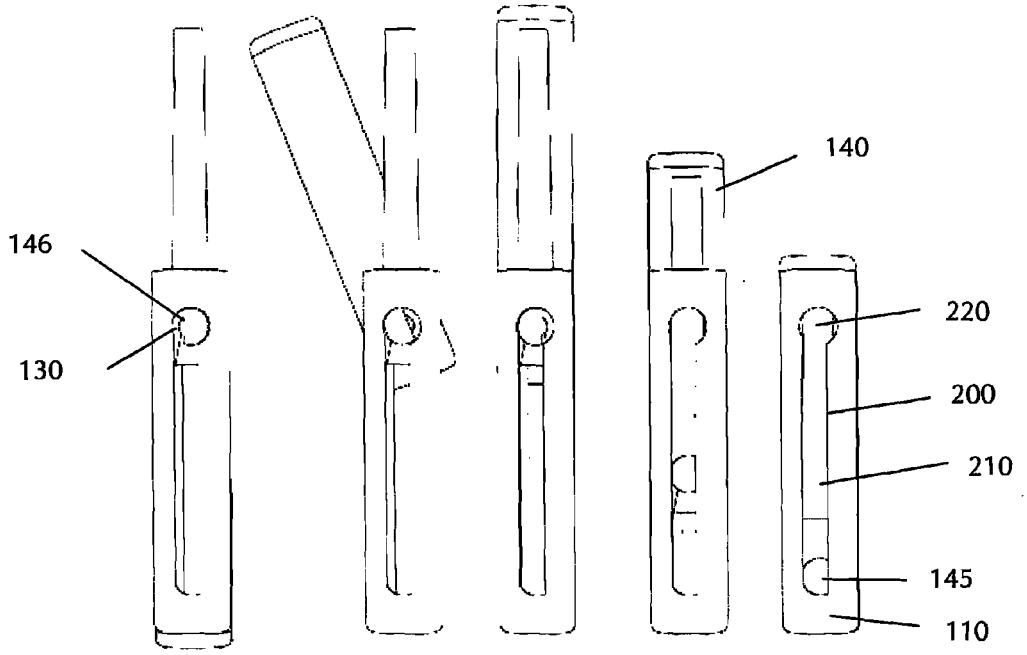
FIGS. 8*a*-8*e* are a side elevation of one embodiment of a compact according to the present invention, wherein the near field portion of the cap is cut away. Each pivot has one straight edge.
Figures 9A, 9B, 9C, 9D, 9E:
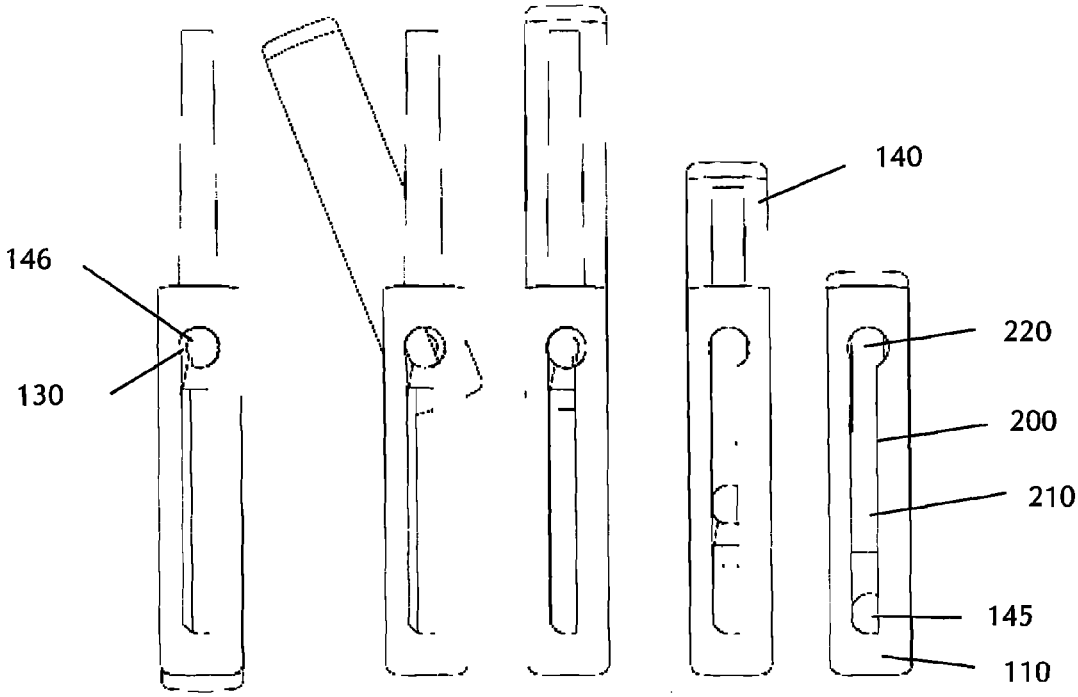
FIG. 9*a*-9*e* are a side elevation of one embodiment of a compact according to the present invention, wherein the near field portion of the cap is cut away. Each pivot has two straight edges.

The carrier slides between a fully retracted position, where it is closest to the bottom (11) of the base, and a fully extended position, where it is closest to the top (14) of the base. In the fully extended position, the article carrier may or may not protrude above the base. For example, in FIG. 6*b*, the article carrier (30) is almost fully exposed, in FIG. 5*c* it is about half exposed, and in FIG. 7 the article carrier is almost not exposed at all. When the cosmetic article is fixed through the top (34) of the carrier (FIG. 5*c*, for example), the degree of exposure of the article carrier is largely controllable and for aesthetic reasons, no portion or little of the article carrier may be exposed. In the configuration of FIG. 6*b*, however, a substantial portion of the article carrier necessarily protrudes from the base. In this case, the article carrier, preferably, has a fine finish or aesthetically acceptable appearance.

The Cap

Figure 3:
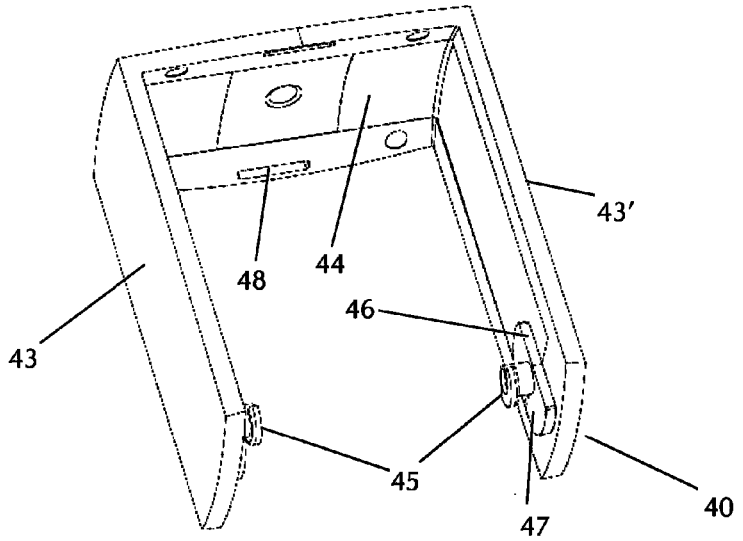
FIG. 3 is a perspective view of a cap of a unitary cosmetic compact according to the present invention.

A cap (40) according to the present invention, is shown in FIG. 3. When assembled, the cap is located external to the base (10) and surrounds a portion of the base. In a preferred embodiment, the cap is generally U-shaped, having two lateral sections (43, 43') and one middle section (44), but the U-shape is not a rigid requirement. The cap is capable of sliding (translating) up and down on the base. Each lateral section of the cap slides over or along a lateral section (13, 13') of the base. When the cap is fully seated against the base, the middle section of the cap covers the opened end of the base. The cap will ordinarily be fashioned from one or more plastics, by any conventional means.

Preferably, the lateral sections (43, 43') of the cap (40) are shaped complementary to the lateral walls (13, 13') of the base (10). This creates a clean appearance and a more easily handled compact. This close fit will also reduce extraneous movement of the cap. Each lateral section is provided with means for attaching to the article carrier (30). The attachment may be one or more pivots (45), for example, one each protruding from the interior surface of each lateral section. The pivots extend into a recess (35), provided in the lateral wall of the article carrier, in a snap-fitted engagement. Alternately, each lateral wall of the carrier could be provided with a pivot that extends to a recess provided on the interior of the lateral sections of the cap. Many equivalent means will be apparent to a person skilled in the art. In either case, the cap attaches to the carrier through the groove(s) (20) of the base. The attachment of the cap to the carrier ensures that when the cap translates vertically, so does the carrier. Thus, when the middle section (44) of the cap is seated against the open end (14) of the base, the cap is at its lowest position and the cosmetic article carrier is at its lowest position, fully retracted into the base. When the middle section of the cap is raised such that the pivots (45) are at their highest vertical extent, then the cosmetic article carrier and cap are also at their highest position or fully extended.

Figure 4A:
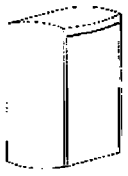
FIGS. 4*a*-4*f* are perspective views that show the sequence of opening of a unitary cosmetic compact according to the present invention. As shown here, the compact houses a stick-type personal care product.
Figure 4B:
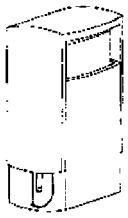
Figure 4C:
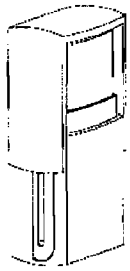
Figure 4D:
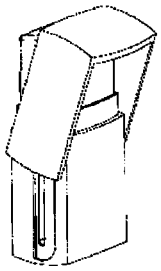
Figure 4E:
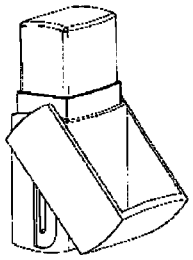
Figure 4F:
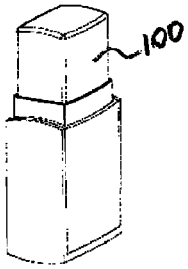

When the cap is any of the positions shown in FIGS. 4*a*, 4*b* and 4*c*, we refer to the cap as being "vertical" and/or not rotated with respect to the base. FIGS. 4*d*, 4*e* and 4*f* show a cap that is rotated with respect to the base. Specifically, in FIG. 4*f*, the cap is rotated 180 degrees with respect to the base. As noted, the cap (40) can rotate, only when the pivots (45) are at their highest vertical extent (or equivalently, only when the cap or article carrier is at its full vertical extent). If the pivots are lower than their highest vertical extent, then the cap is prevented from rotating. Specific examples for accomplishing this will be described. The examples concern the geometry of the grooves (20) and the geometry of the attachments (i.e. pivots) that travel in the grooves. However, the general principle involved in the present invention is any selective rotation mechanism, where "selective rotation mechanism" is defined as an arrangement that satisfies the following three requirements:

1. a selective rotation mechanism prevents rotation of the cap when the pivots are below their full vertical extent;

2. a selective rotation mechanism allows rotation of the cap when the pivots are at their full vertical extent;

3. a selective rotation mechanism permits translation of the cap only when the cap is vertical (that is, not rotated with respect to the base).

Stated more concisely, a selective rotation mechanism only allows rotation of the cap when the cap is fully extended with respect to the base, and only permits translation of the cap when the cap is not rotated with respect to the base. Taken together, these requirements also mean that the cap cannot translate and rotate simultaneously. We say, the cap cannot perform a compound motion or equivalently, the motion of the compact is decoupled.

EXAMPLES OF A SELECTIVE ROTATION MECHANISM

Example 1

In one embodiment (see FIG. 1), the base (10) comprises at least one recessed section (15) and at least one groove within the recess. Preferably, the base comprises two recesses, one on each lateral wall (13, 13') of the base. Each recess is in two sections. One section is a relatively long, straight recess (16) that runs vertically, along a lateral wall of the base. Approaching the top of the base, the straight recess opens into a circular recess (17). The circular recess has a diameter that is larger then the width of the straight recess. The entire recess is defined by a recess wall that bounds the recess. The straight recess is bounded on both sides by straight, parallel sections (18) of the recess wall. The circular recess is bounded by a circular section (19) of the recess wall. Within each recess is a groove (20). The groove is substantially straight and may or may not have a circular portion at the top end of the groove. In the embodiment shown in the FIG. 1, the groove may be thought of as comprising a straight groove and a circular groove. The straight groove (21) runs vertically, along a lateral wall of the base, keeping within the straight recess. Upon reaching the circular recess, the straight groove opens into a circular groove (22).

The circular groove (22) and circular recess (17) are substantially concentric and the center line of the straight groove (21) passes through the centers of circular groove and circular recess. However, the center line of the straight recess (16) is offset from the center line of the straight groove (see below for discussion). Thus, the center line of the straight recess does not pass through the centers of circular groove and circular recess. The pivots (45), travel along the grooves (20), such that, the center of the each pivot travels along the center line of the straight groove.

Very near the pivots, also projecting from the interior surface of the cap, are one or more straight edges (46, FIG. 3). The straight edges travel within the straight recesses (16), wherein they have close contact with the recess wall (18) on either side of the straight recess. Thus, the straight edges are offset, with respect to the straight grooves (21, 21'), in the same direction as the straight recesses. The straight edges are parallel to the recess wall and sufficiently long compared to the width of the straight recess, such that the abutment of the straight edges against the recess wall prevents appreciable rotation of the cap. Thus, when the straight edges are below the circular recess (17), the cap is capable of translation with respect to the base (10), but not rotation.

The straight edge (46) shown in FIG. 3, is implemented as a flange (47) that surrounds the base of the pivot (45). The flange may be circular except for one or more straight portions, which implement the straight edge(s). When two straight edges are provided, each straight edge has close contact with the recess wall (18) on each side of the straight recess. The straight edges may be same or different lengths. Preferably, the circular portion of the flange has a diameter that is only slightly smaller than the diameter of the circular recess. This close fit will inhibit extraneous motion of the cap with respect to the base and make a more secure device. If the flange has no circular portion, then the length of at least one straight edge may be as close as possible to the diameter of the circular recess. In either case, the straight edges must be shorter than the diameter of the circular recess, so that the straight edges can fit into, and rotate within, the circular recess. Thus, when the straight edges enter the circular recesses, the straight edges can rotate, and, of course, the cap also rotates.

An alternate implementation of a straight edge is one or more straight ridges provided on either or both sides of the pivot. The flange may be preferred to the ridges, however, because a fully implemented flange, as shown in FIG. 3, may be stronger than a thin ridge and provide superior resistance to wear and tear. In either case, when the straight edges are below the circular recess (17), the cap is capable of translation with respect to the base (10), but not rotation.

Once the straight edges (46) have entered the circular recesses (17) and once the cap (40) has rotated away from vertical, the same straight edges cannot reenter the straight recess (16), because the straight edges are longer than the width of the straight recess. This prevents the pivot (45) from reentering the straight groove and thus, prevents the cap from descending. However, once the cap has rotated 180 degrees, the straight edges would again be vertical and be able to reenter the straight recess, unless some other measure is taken.

As noted, the center line of the straight recess (16) is offset from the center line of the straight groove (21). Also, the straight edge(s) (46) is offset in the same direction as the straight recess. In other words, there is a larger portion of the flange toward one side of the straight groove and a smaller portion toward the other side of the straight groove. Furthermore, it is preferable that, on opposite sides of the base (10), the offsets of the straight recesses are opposite or reversed, with respect to each other. If the offsets of the straight recesses are reversed with respect to each other, then the flange offsets on either side of the base are also reversed with respect to each other. This configuration is expected to create even greater stability for the compact when in use.

As the cap is raised, the flange travels parallel to, but offset from, the center line of the straight groove. Upon exiting the straight recess, entering the circular recess (17), and rotating the cap 180 degrees, the larger portion flange moves toward the opposite side of the straight recess. However, due to the flange being offset with respect to the pivot, the larger portion of the flange extends laterally beyond the top of the straight recess. If we try to lower the cap from this position, the larger portion of the flange contacts the wall of the circular recess and is prevented from translating down the straight groove.

Therefore, when the cap (40) has rotated less than 180 degrees, the dimensions of the straight edges (46) are too large to fit into the straight recess (16). And when the cap has rotated appreciably 180 degrees, the straight edges are out of alignment to reenter the straight recess. Either way, the rotated cap cannot reenter the straight recess or the rotated cap cannot translate.

Thus, when the pivots (45) are below their full vertical extent, the straight edges (46) allow translation of the cap (40), but prevent rotation of the cap. Furthermore, when the pivots are at their full vertical extent, the straight edges allow rotation of the cap, but prevent translation, except when the cap is vertical above the compact. Only when the cap is vertical above the compact, does the user have a choice of how to move the cap (translation or rotation). However, only one motion is possible at a time. This combination of features imparts stability and convenience, while being simple to implement and unlike anything in the prior art.

Example 2

The following example is somewhat simpler than the previous and shown in FIGS. 8*a*-8*e*. To reveal the detail underneath, FIG. 8 shows the working of a compact, with a portion of the cap (140) cut away. Again, the groove (200) may be thought of as comprising two parts, a straight groove (210) and an offset circular groove (220). In this embodiment, the circular groove (or a functional equivalent) is required. The straight groove runs vertically, along a lateral wall of the base (110) and opens into the offset circular groove. Unlike the previous example, there is no recess surrounding the groove. The circular groove is offset from the center line of the straight groove, such that one edge of the straight groove is substantially tangent to the perimeter of the circular groove. Furthermore, the offset of the circular groove on one side of the base is opposite to the offset on the other side of the base. The reason for this will be made clear, below.

The pivots (145) project from each interior surface of the lateral sections of the cap (140), and travel along the grooves (200). The pivots proper are substantially cylindrical, except for a flattened portion which implements the straight edge (146). Each straight edge is toward the same direction as the offset of the circular groove in which it travels. Thus the straight edge on one side of the cap faces a direction opposite to the straight edge on the other side of the cap. The relative position of the pivots is such that the center of the each pivot travels along the center line of the straight groove. The straight edges fit snugly against and are parallel to the wall of groove and the rounded portion of each pivot contacts the opposite wall of the groove. Preferably, the width of the pivot is very close to the width of the straight groove. This will limit any extraneous movement of the cap. The straight edges are sufficiently long compared to the width of the straight groove, such that the abutment of the straight edges against the groove wall prevents appreciable rotation of the cap. Thus, while the straight edges are below the circular groove, the cap is capable of translation with respect to the base (110), but not rotation.

Upon exiting the straight groove (210) and entering the circular groove (220) and rotating the cap 180 degrees (see FIG. 8*e*), the rounded portion of the pivot (145) rotates into the opposite side of the circular groove. However, due to that side of the circular groove being offset with respect to the straight groove, the rounded portion of the pivot extends laterally beyond the top of the straight groove. If we try to lower the cap from this position, the cap is prevented from translating by the rounded portion of the pivot contacting the wall of the circular groove. However, the opposite side of the pivot (i.e. the straight edge (146) of the pivot) is not abutting anything, and a lateral pressure could force the pivot back into alignment with the straight groove, whence translation of the cap would be possible. To prevent this, the offset of the circular groove on one side of the base is opposite to the offset on the other side of the base. Thus, in order for the cap to translate back down the straight groove, both pivots would have to be simultaneously pressured in opposite directions. This is very improbable by chance. Furthermore, the pivots are connected to the article carrier (130) and the snug fit of the carrier in the base, substantially prevents lateral movement of the pivots. Thus, the opposing offsets of the circular grooves is an optional feature if the snug fit of the carrier in the base is sufficient to prevent lateral movement of the pivots, and thereby prevent translation of the cap.

Example 3

The following example is very similar to the example 2 and shown in FIGS. 9*a*-9*e*. To reveal the detail underneath, FIG. 9 shows the working of a compact, with a portion of the cap (140) cut away. Again, the groove (200) may be thought of as comprising two parts, a straight groove (210) and an offset circular groove (320). In this embodiment, the circular groove (or a functional equivalent) is required. The straight groove runs vertically, along a lateral wall of the base (110) and opens into the offset circular groove. Again, there is no recess surrounding the groove. The circular groove is offset from the center line of the straight groove, but not as much as in example 2. Thus, the edge of the straight groove is not tangent to the perimeter of the circular groove. As before, the offset of the circular groove on one side of the base is opposite to the offset on the other side of the base.

The pivots (245) project from each interior surface of the lateral sections of the cap (140), and travel along the grooves (200). The pivots proper are substantially cylindrical, except for one long (146) and one short (147) flattened portion, which implement the straight edges. Each long straight edge is toward the same direction as the offset of the circular groove in which it travels. Thus the long straight edge on one side of the cap faces a direction opposite to the long straight edge on the other side of the cap. The relative position of the pivots is such that the center of the each pivot travels along the center line of the straight groove. The long and short straight edges fit snugly against and are parallel to the walls of groove. Preferably, the width of the pivot is very close to the width of the straight groove. This will limit any extraneous movement of the cap. The straight edges are sufficiently long compared to the width of the straight groove, such that the abutment of the straight edges against the groove wall prevents appreciable rotation of the cap. Thus, while the straight edges are below the circular groove, the cap is capable of translation with respect to the base (110), but not rotation.

Upon exiting the straight groove (210) and entering the circular groove (320) and rotating the cap 180 degrees (see FIG. 8*e*), the short straight edges of the pivot (245) rotate to the opposite side of the circular groove. However, due to that side of the circular groove being offset with respect to the straight groove, the pivot extends laterally beyond the top of the straight groove. If we try to lower the cap from this position, the cap is prevented from translating by the rounded portion of the pivot contacting the wall of the circular groove. However, the opposite side of the pivot (i.e. the long straight edge (146) of the pivot) is not abutting anything, and a lateral pressure could force the pivot back into alignment with the straight groove, whence translation of the cap would be possible. To prevent this, the offset of the circular groove on one side of the base is opposite to the offset on the other side of the base. Thus, in order for the cap to translate back down the straight groove, both pivots would have to be simultaneously pressured in opposite directions. This is very improbable by chance. Furthermore, the pivots are connected to the article carrier (130) and the snug fit of the carrier in the base, substantially prevents lateral movement of the pivots. Thus, the opposing offsets of the circular grooves is an optional feature if the snug fit of the carrier in the base is sufficient to prevent lateral movement of the pivots, and thereby prevent translation of the cap.

In summary, when the cap (140) has rotated less than 180 degrees, the dimensions of the straight edges (146) are too large to enter the straight grooves (210), so translation of the cap is impossible. When the cap has rotated appreciably 180 degrees, the straight edges are also prevented from reentering the straight grooves by one of the means just described or by equivalent means which may now occur to a person of ordinary skill in the art.

Thus, when the pivots (145 or 245) are below their full vertical extent, the straight edges (146) allow translation of the cap (140), but prevent rotation of the cap. Furthermore, when the pivots are at their full vertical extent, the straight edges allow rotation of the cap, but prevent translation, except when the cap is vertical above the compact. Only when the cap is vertical above the compact, does the user have a choice of how to move the cap (translation or rotation). However, even then, only one motion is possible at a time. This combination of features imparts stability and convenience, while being simple to implement and unlike anything in the prior art.

Optional Features and Preferences

A Modified Selective Rotation Mechanism

Optionally, multiple circular grooves and/or circular recesses, similar to those above described, may be provided along the straight grooves and/or straight recesses, respectively. FIG. 5*a* shows a compact with multiple circular recesses. This gives a user the choice of extending the cosmetic article to less than its full extent. This modification maintains the spirit of the invention in that:

1. there are only a few well defined configurations of the compact from which both rotation and translation of the cap may occur, but even there, both cannot occur simultaneously, and 2. the cap still cannot perform a compound motion A "modified selective rotation mechanism" is defined as an arrangement that satisfies the following requirements:

1. a modified selective rotation mechanism prevents rotation of the cap, except at discrete, well defined positions along the grooves;

2. a selective rotation mechanism permits translation of the cap only when the cap is vertical (that is, not rotated with respect to the base).

Taken together, these requirements also mean that the cap cannot translate and rotate simultaneously. We say, the cap cannot perform a compound motion or equivalently, the motion of the compact is decoupled.

Optionally, the ends of the pivots (45) may be provided with raised features that prevent them from backing out of the cosmetic carrier (30). Optionally, snap fitments (23, 48) located on the base (10) and cap (40), respectively, may be provided, to hold the cap in a closed or open position.

When the pivots (45) are in the circular grooves (19), the cap (40) may be rotated. Preferably, the cap can rotate 180° in one direction. More preferably, the cap can rotate 180° in either direction. Most preferably, the cap can rotate a full 360° in either direction, so that the user does not have to think about choosing the direction to open or close the compact. Once the cap has rotated with respect to the base (10), the cap cannot perform translation because the selective rotation mechanism (or modified selective rotation mechanism) forbids it. To translate the cap, the cap must be returned to vertical, above the base. Thus, only when the pivots are in the circular grooves can the cap be rotated.

Furthermore, there is only one configuration of the compact (or a few discrete configurations, in the case of a modified selective rotation mechanism) from which both rotation and translation of the cap (40) may occur. By "only one configuration" or "a few discrete configurations" I mean to exclude slight variations of the configuration that arise due to some play in the fit of the components. Maintaining routine tolerances in the art of plastic component manufacture will ensure that the spirit of this invention is followed. Tighter tolerances may only add slight improvement.

In the embodiments thus described, vertical translation of the cap (40) is effected by a user directly contacting the base (10) and the cap, and forcing them apart or together. But without changing the spirit of the invention, more complex means may be provided. For example, the cap of the compact may be fitted to a riser mechanism like something well known in the lipstick art, whereby turning the bottom of the mechanism raises or lowers the cap. Or the cap my be made part of a ratchet mechanism, whereby repeatedly pressing a button on the side of the compact, raises or lowers the cap. Whatever the raising and lowering means, translation and rotation of the cap cannot occur simultaneously, to maintain the benefits of the invention.

In FIG. 4*f*, the cosmetic article (50) protrudes from the top (34) of the cosmetic article carrier (30) so that most of the cosmetic article is exposed. FIG. 6 is an alternate embodiment, wherein most of the cosmetic article is protected and only one side or portion is exposed. This configuration does not lend itself to drawing the product across the skin and may be more suitable for use with an applicator that transfers product from the device to the skin, for example, an eyeshadow or blush product. Optionally, in this (or any of the previously described) embodiments, an applicator (51) or auxiliary cosmetic article may be stored in the side (or other portion) of the cosmetic article carrier (30), where it cannot fall out of the compact when the compact is in the closed position. In fact, as shown in FIG. 6, the auxiliary article cannot be removed or fall out of the compact until the cap is rotated away from vertical.

Optionally, in any of the described embodiments, a closed compact may afford a view of the cosmetic article (50). This can be achieved by providing window (52) in the base, as shown in FIG. 6.

Optionally, one or more portions of the compact exterior may support a mirror for the convenience of the user. For example, in embodiments like FIGS. 1-5, the front (12) or back (12') of the base (10) provide a convenient place for locating a mirror. In an embodiment like FIG. 6, the back of the article carrier may also be used.

Many such enhancements may be apparent to a person skilled in the art, without enhancing the spirit of the invention, which is a unitary cosmetic compact comprising a base, a cap, an article carrier and a selective rotation mechanism, wherein the cap is capable of translation and rotation with respect to the base, such that once the cap has rotated away from a coaxial orientation with the base, the cap is no longer capable of translation; and wherein there is only one orientation of the cap with respect to the base from which both translation and rotation are possible; and wherein the cap is prevented from pivoting and translating at the same time.

What is claimed is:

1. A unitary cosmetic compact comprising a hollow base having at least one wall and an opened top, the wall having at least one groove that has a lower end further from the top, and an upper end nearer to the top;

an article carrier disposed within the base through the top, wherein the article carrier is capable of translation with respect to the base;

a cap that surrounds a portion of the base, wherein the cap is capable of translation and rotation with respect to the base;

an attachment through the at least one groove, attaching the article carrier to the cap, such that the cap, attachment and article carrier translate together, between a fully retracted position, associated with the lower end of the at least one groove, and a fully extended position, associated with the upper end of the at least one groove; and a selective rotation mechanism that only permits rotation of the cap when the article carrier is fully extended with respect to the base, and that only permits translation of the cap when the cap is not rotated with respect to the base, wherein each groove comprises a straight groove that runs vertically along the at least one wall of the base and that opens into a circular groove, the circular groove having a diameter that is larger than the width of the straight groove;

each groove is surrounded by a recess, defined by a recess wall, and comprising a straight recess that runs vertically along the at least one recess of the base and that opens into a circular recess, the circular recess having a diameter that is larger than the width of the straight recess;

the circular groove and circular recess are concentric and the center line of the straight groove passes through the centers of circular groove and circular recess; and wherein the center line of the straight recess is offset from the center line of the straight groove and offset from the center of the circular recess.

2. The cosmetic compact of claim 1 wherein the article carrier is suitable to securely hold a cosmetic article, such as a brush, comb, stick product or pan containing a product.

3. The cosmetic compact of claim 1, wherein the attachment comprises one or more pivot elements, wherein the pivot elements arise from the cap or article carrier and extend through the at least one groove toward the article carrier or cap, respectively.

4. The cosmetic compact of claim 1, wherein the cap is generally U-shaped, having two lateral sections and one middle section, which translate between a fully extended position and a fully retracted position, such that when in the fully retracted position, the middle section covers the top of the base.

5. The cosmetic compact of claim 4, wherein the attachment comprises one or more pivot elements that arise from the lateral sections of the cap and extend through the at least one groove toward the article carrier.

6. The cosmetic compact of claim 5, wherein the one or more pivots form a snap-fitted engagement with the article carrier.

7. The cosmetic compact of claim 1 wherein the offsets of two or more straight recesses are in different directions.

8. The cosmetic compact of claim 1, wherein the cap further comprises:

one or more straight edges that translate within the straight recesses, parallel to the recess wall;

the straight edges being sufficiently long compared to the width of the straight recesses, such that rotation of the cap is prevented whenever the straight edges are within the straight recesses.

9. The cosmetic compact of claim 8, wherein:

the straight edges are shorter than the diameter of the circular recesses, so that the straight edges can fit into, and rotate within, the circular recesses.

10. The cosmetic compact of claim 9, wherein the length of the straight edge is as close as possible to the diameter of the circular recess.

11. The cosmetic compact of claim 10, wherein each straight edge is implemented as a flange that surrounds the base of one of the pivots, the flange being basically circular except for one or more straight portions.

12. A unitary cosmetic compact comprising a hollow base having at least one wall and an opened top, the wall having at least one groove that has a lower end further from the top, and an upper end nearer to the top;

an article carrier disposed within the base through the top, wherein the article carrier is capable of translation with respect to the base;

a cap that surrounds a portion of the base, wherein the cap is capable of translation and rotation with respect to the base;

an attachment through the at least one groove, attaching the article carrier to the cap, such that the cap, attachment and article carrier translate together, between a fully retracted position, associated with the lower end of the at least one groove, and a fully extended position, associated with the upper end of the at least one groove; and a selective rotation mechanism that only permits rotation of the cap when the article carrier is fully extended with respect to the base, and that only permits translation of the cap when the cap is not rotated with respect to the base, wherein:

each groove is defined by a groove wall and comprises a straight groove that runs vertically along the at least one wall of the base and that opens into a circular groove, the circular groove having a diameter that is larger than the width of the straight groove and wherein the center line of the straight groove, is offset from the center of the circular groove.

13. The cosmetic compact of claim 12 wherein the offsets of two or more straight grooves are in different directions.

14. The cosmetic compact of claim 12, wherein the cap further comprises:

one or more straight edges that translate within the straight grooves, parallel to the straight groove wall;

the straight edges being sufficiently long compared to the width of the straight grooves, such that rotation of the cap is prevented whenever the straight edges are within the straight grooves.

15. The cosmetic compact of claim 14, wherein:

the straight edges are shorter than the diameters of the circular grooves, so that the straight edges can fit into, and rotate within, the circular grooves.

16. The cosmetic compact of claim 15, wherein the lengths of at least some straight edges are as close as possible to the diameter of the circular groove.

17. The cosmetic compact of claim 16, wherein each straight edge is implemented as a flange that surrounds the base of one of the pivots, the flange being basically circular except for one or more straight portions.

18. The cosmetic compact of claim 1, wherein the cap may rotate a full 360° in either direction.

19. The compact of claim 1 further comprising a cosmetic product disposed within the article carrier.

20. The compact of claim 19 wherein all or most of the cosmetic product is recessed into a wall of the article carrier.

21. The compact of claim 1 further comprising an auxiliary cosmetic article, and/or a window and /or a mirror.

22. The cosmetic compact of claim 12, wherein the cap may rotate a full 360° in either direction.

23. The compact of claim 12 further comprising a cosmetic product disposed within the article carrier.

24. The compact of claim 12 further comprising an auxiliary cosmetic article, and/or a window and /or a mirror.

* * * * *